United States Patent [19]

Reist

[11] Patent Number: 4,811,548

[45] Date of Patent: Mar. 14, 1989

[54] METHOD OF, AND APPARATUS FOR, FABRICATION OF PORTABLE TUBULAR-SHAPED PACKAGES FORMED OF PRINTED PRODUCTS, SUCH AS NEWSPAPERS, PERIODICALS, AND THE LIKE AND PORTABLE PACKAGE PRODUCED ACCORDING TO THE METHOD

[75] Inventor: Walter Reist, Hinwil, Switzerland

[73] Assignee: Ferag AG, Hinwil, Switzerland

[21] Appl. No.: 49,586

[22] Filed: Apr. 30, 1987

[30] Foreign Application Priority Data

May 2, 1986 [CH] Switzerland ..... 1815/86

[51] Int. Cl.[4] ..... B65B 25/24; B65B 61/14

[52] U.S. Cl. ..... 53/409; 53/413; 53/430; 53/118; 53/134; 53/204; 53/582

[58] Field of Search ..... 53/399, 409, 413, 430, 53/134, 118, 204, 581, 582; 100/12; 242/59, 96, 55.2; 206/389

[56] References Cited

U.S. PATENT DOCUMENTS

| | | | |
|---|---|---|---|
| 833,238 | 10/1906 | Pitschke | 292/55.2 |
| 2,033,201 | 3/1936 | MacChesney | 53/209 |
| 2,212,668 | 8/1940 | Mirfield . | |
| 2,910,814 | 11/1959 | Yelinek | 53/409 |
| 3,069,822 | 12/1962 | Macleod | 53/430 |
| 3,670,877 | 6/1972 | Reed | 53/409 X |
| 3,856,141 | 12/1974 | Reed | 53/409 X |
| 4,601,436 | 7/1986 | Honegger | 53/118 X |

FOREIGN PATENT DOCUMENTS

| | | | |
|---|---|---|---|
| 0054973 | 6/1982 | European Pat. Off. . | |
| 1069523 | 11/1959 | Fed. Rep. of Germany . | |
| 1153676 | 8/1963 | Fed. Rep. of Germany . | |
| 1801178 | 4/1970 | Fed. Rep. of Germany | 100/12 |
| 2035244 | 2/1972 | Fed. Rep. of Germany | 206/389 |
| 2430603 | 1/1976 | Fed. Rep. of Germany . | |
| 3137402 | 4/1983 | Fed. Rep. of Germany | 206/389 |
| 2347188 | 11/1977 | France . | |
| 960081 | 9/1982 | U.S.S.R. | 53/430 |
| 2126188 | 3/1984 | United Kingdom . | |
| WO84/02893 | 8/1984 | World Int. Prop. O. | 206/389 |

*Primary Examiner*—John Sipos

*Attorney, Agent, or Firm*—Werner W. Kleeman

[57] ABSTRACT

Printed products arriving in an imbricated formation are wound-up into a product or package roll about which there is placed a wrapper or envelope which retains together the package roll. For easier handling of the product or package roll such is provided with an endless carrying loop. This endless carrying loop is formed by a carrying element, such as a knotted cord, rope, string or the like which extends through an internal opening or hollow interior of the product or package roll and to the outer side or surface of such product or package roll.

23 Claims, 6 Drawing Sheets

44
K
43
I
45'''
35
34a
34
36
33
J
37
45'
45'''
32
38
39
28
29
40a
40
7
8
25'
16
17
18
22'
5
12
46
8
28
45'
3
14
13a
13
30
29
31
L
1

34a
35
J
34
33
32
37
38
39
40a
43
K
L
40
12
45'
46
28
13a
13
15
41

45"
47
40'

METHOD OF, AND APPARATUS FOR, FABRICATION OF PORTABLE TUBULAR-SHAPED PACKAGES FORMED OF PRINTED PRODUCTS, SUCH AS NEWSPAPERS, PERIODICALS, AND THE LIKE AND PORTABLE PACKAGE PRODUCED ACCORDING TO THE METHOD

CROSS REFERENCE TO RELATED APPLICATION

This application is related to the commonly assigned, copending U.S. application Ser. No. 06/818,356, filed June 13, 1986, and entitled "METHOD OF PREPARING A SHIPMENT PACKAGE OF PRINTED PRODUCTS ARRIVING IN AN IMBRICATED FORMATION AND PACKAGE OBTAINED THEREBY", now U.S. Pat. No. 4,688,368, granted Aug. 25, 1987.

BACKGROUND OF THE INVENTION

The present invention relates to a new and improved method of, and apparatus for, the fabrication of portable or transportable, substantially tubular-shaped packages or product or package rolls composed of printed products, such as typically although not exclusively, newspapers, periodicals and the like. The invention also relates to an improved tubular-shaped package or package roll formed according to the method.

In its more particular aspects the method for the fabrication of portable, substantially tubular-shaped product or package rolls formed of printed products, such as newspapers, periodicals and the like, contemplates winding up into a product or package roll printed products arriving or delivered in imbricated formation. About the thus formed product or package roll there is placed a holding or retention element for holding together the product or package roll.

The invention also concerns an apparatus for the fabrication of portable or readily transportable, substantially tubular-shaped product or package rolls formed of printed products, such as newspapers, periodicals and the like, which comprises an apparatus or device for winding up of the printed products infed in imbricated formation so as to form a product or package roll and for the application of a holding or retention element which extends about the product or package roll for retention or holding together of such product or package roll.

As further noted previously, the present invention is also concerned with a product or package roll which is produced in accordance with the method aspects of the present development. This product or package roll comprises a package roll or roll member formed by wound-up printed products and which package roll is retained together by a holding or retention element.

In German Published Patent Application No. 3,330,485 and the cognate British Published Patent Application No. 2,126,188, published Mar. 21, 1984 and the aforementioned cognate, copending U.S. application Ser. No. 06/818,356, filed Jan. 13, 1986, , now U.S. Pat. No. 4,688,268, granted Aug. 25, 1987, it is known in this technology to form shipment-ready packages by winding up printed products into a package roll and which arrive in imbricated formation. These packages or package rolls can be manually transported and the individual printed products can be removed from the center of the package or package roll. The disintegration of the package or package roll is prevented by placement thereabout of a wrapper or envelope or equivalent retention structure.

SUMMARY OF THE INVENTION

It is a primary object of the present invention to provide a new and improved method of, and apparatus for, the fabrication or portable or readily transportable substantially tubular-shaped packages or product or package rolls formed of printed products, such as typically although not exclusively newspapers, periodicals and the like, in a highly efficient and reliable fashion.

Yet a further significant object of the present invention is directed to the formation of an improved construction of a portable package roll or package which is compact, stable and easy to transport or carry without danger of unraveling or disintegration.

Yet a further significant object of the present invention is directed to a new and improved construction of apparatus for the fabrication or manufacture of portable, substantially tubular-shaped packages or product or package rolls formed of predeterminate products, in particular printed products, such as for instance newspapers, periodicals and the like, which apparatus is relatively simple in construction and design, quite economical to manufacture, highly reliable in operation, not readily subject to breakdown or malfunction, and requires a minimum of maintenance and servicing.

Another extremely important object of the present invention is directed to a new and improved method of, and apparatus for, the fabrication of printed product rolls or package rolls of the aforementioned type without any appreciable greater expenditure in equipment or fabrication effort, and which printed product rolls or package rolls can be even more easily handled than was heretofore the case.

Now in order to implement these and still further objects of the invention, which will become more readily apparent as the description proceeds, the method of the present development is manifested by the features that an elongate carrying or transporting element is guided through the hollow interior of the package roll and also so as the extend along or at the outer side or surface of the package roll, so that there is thus formed an endless or closed carrying or carrier loop for the package roll and which surrounds such package roll.

As alluded to above the invention is not only concerned with the aforementioned method aspects, but also relates to a new and improved construction of an apparatus for the fabrication of portable, substantially tubular-shaped packages or package rolls formed of printed products, such as newspapers, periodicals and the like, wherein there is provided an arrangement for the formation of an endless or closed carrying or carrier loop which surrounds the finished package roll. This carrying or carrier loop or equivalent roll carrying or transporting structure comprises an elongate carrying or carrier element which, on the one hand, is guided through the hollow interior of the package roll and, on the other hand, extends around the outer surface or side of the package roll.

Furthermore, the new and improved construction of a product or package roll, produced according to the method aspects of the present development, is manifested by the features that an endless or closed carrying or carrier loop which surrounds or loops about the package roll is formed by an elongate carrying or carrier element. This elongate carrying or carrier element or equivalent structure is guided, on the one hand, through the hollow interior or inner side of the package roll and, on the other hand, extends along the outer side or outer surface of the package roll. The carrying element may be placed as an endless loosely threaded loop or carrying element for convenient handling or transport of the package roll.

By means of the endless or closed carrying or direction of extent of the product or package roll it is possible to readily manually seize and manipulate the product or package roll. This carrying or carrier loop can be especially formed with relatively little effort following the fabrication or manufacture of the product or package roll if the carrying element is guided through a winding or wind-up core or mandrel upon which there have been wound-up the printed products or the like and after completion of the product or package roll the latter is withdrawn from the winding or wind-up core or mandrel, whereupon there is formed the carrying or carrier loop from the carrying or carrier element extending through the hollow interior or inner side of the package roll. Preferably the carrying or carrier element is fixedly retained at one end externally of the winding core or mandrel and upon retraction of the package roll from the winding core or mandrel this carrying or carrying element is further pulled off or withdrawn from a storage or supply, for instance a supply roll.

Further details of the construction of the apparatus for the formation of the portable, substantially tubular-shaped package rolls, resulting in a simple construction of such apparatus, will be disclosed hereinafter.

BRIEF DESCRIPTION OF THE DRAWINGS

The invention will be better understood and objects consideration is given to the following detailed description thereof. Such description makes reference to the annexed drawings wherein throughout the various figures of the drawings, there have been generally used the same reference characters to denote the same or analogous components and wherein:

FIG. 3 to 8 depict, based upon certain of the more important components or elements of the apparatus shown in FIGS. 1 and 2, different operational phases of the apparatus for the formation of the carrying or carrier loop or the like;

DETAILED DESCRIPTION OF THE PREFERRED EMBODIMENTS

Figure 1:
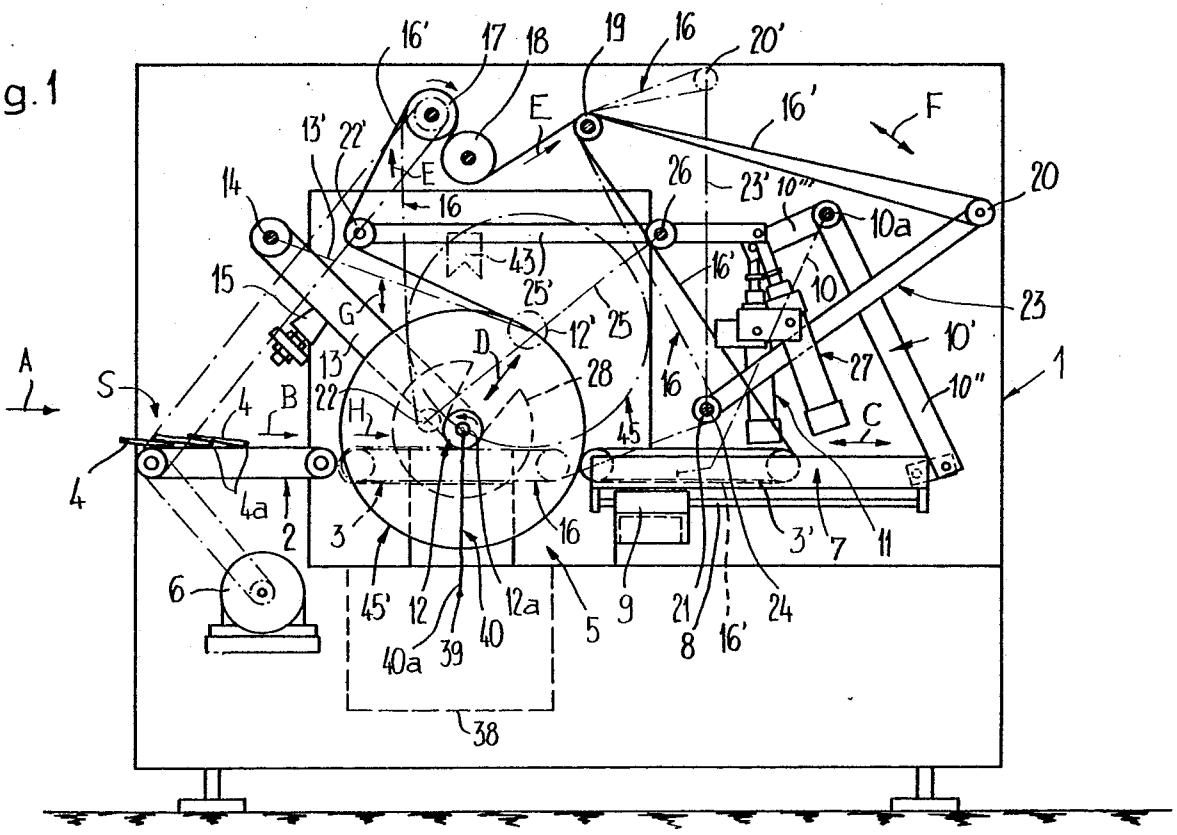
FIG. 1 illustrates in side and in sectional view, taken substantially along the line I—I of FIG. 2, an apparatus for the formation or fabrication of printed product rolls or package rolls provided with a carrying or carrier loop or equivalent roll handling or transportation facility.

Describing now the drawings, it is to be understood that only enough of the construction of the apparatus for the fabrication of portable or transportable, substantially tubular-shaped packages or product or package rolls of printed products, such as typically but not exclusively newspapers, periodicals and the like, has been conveniently illustrated in the drawings as needed for those skilled in the art to readily understand the underlying principles and concepts of the present development, while simplifying the showing of the drawings.

Furthermore, in the description to follow there will be explained in detail, based upon the showing of FIGS. 1 and 2, an exemplary embodiment of apparatus for the formation of an printed product rolls or package rolls provided with an endless or closed carrying or carrier loop or carrying handle or the like. Moreover, for a complete understanding of the construction and the mode of operation FIGS. 3 to 8 inclusive.

Figure 2:
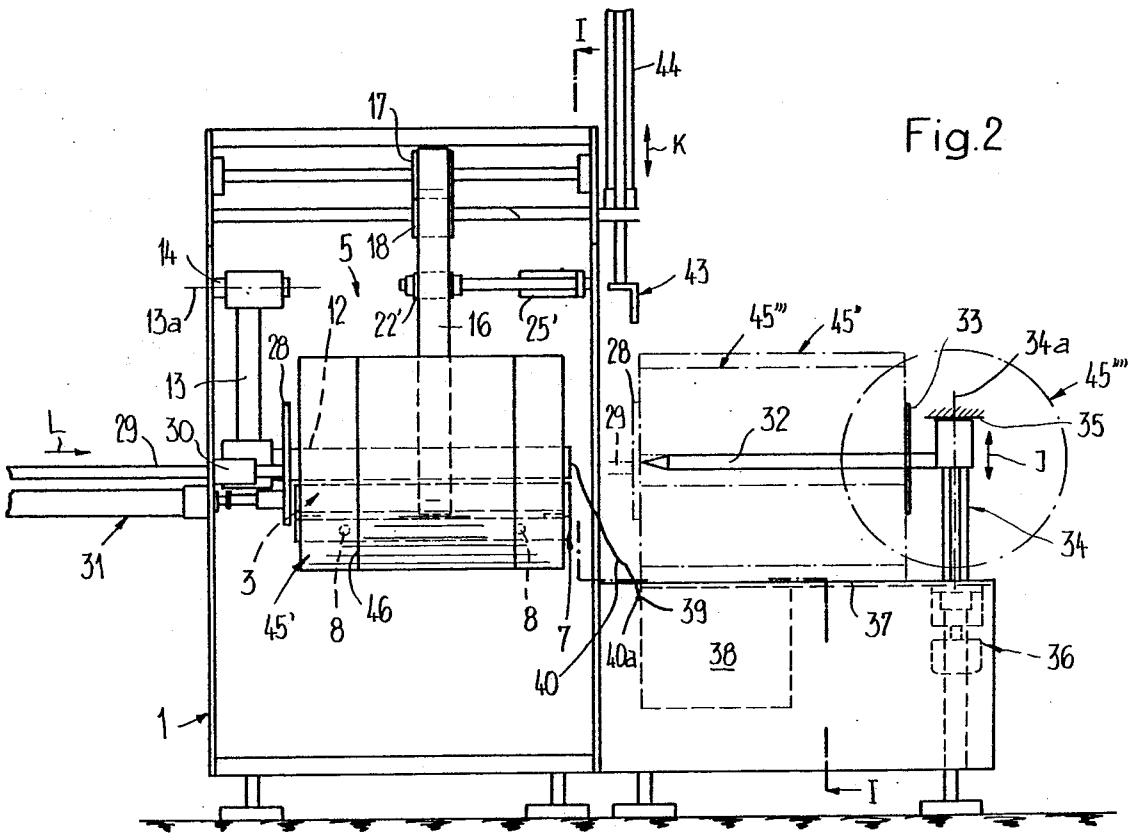
FIG. 2 is a front view of the apparatus depicted in FIG. 1, looking in the direction of the arrow A of such FIG. 1, wherein certain components or parts have been conveniently omitted in order to enhance the clarity of illustrations.
Figure 3:
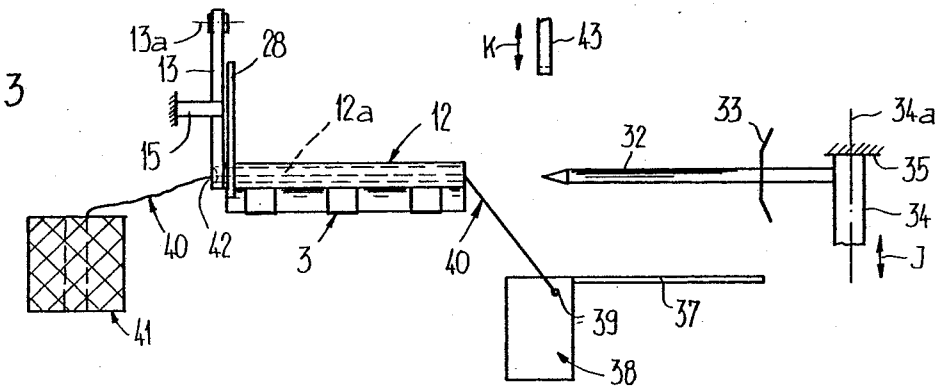

Turning attention now to FIGS. 1 and 2 of the drawings, the product or package roll fabrication apparatus depicted therein by way of example and not limitation, will be seen to comprise a frame or frame member 1 in which there are arranged in succession two band or belt conveyors 2 and 3. The first band or belt conveyor 2 serves for the infeed or delivery of the printed products 4 to a wind-up location or position 5. These printed products 4 arrive in imbricated formation S and are wound up into a package roll or roll structure. The conveying or feed direction of the band or belt conveyor 2, driven by a suitable drive unit or drive motor 6, has been designated in FIG. 1 by reference character B. In the infed imbricated formation S of printed products 4 each such printed product 4 bears upon the next following or trailing printed product 4, as best seen by referring to FIG. 1. This means that the leading edges **4*a* of the printed products 4 contained in the infed or delivered imbricated formation S are located at the underside of such imbricated formation S, again as clearly recognized by referring to FIG. 1**.

The second band or belt conveyor 3 is arranged in a carriage or carriage member 7 which is displaceably mounted for to-and-fro movement by means of two guide rods 8 or the like in a guide or guide member 9 arranged in the frame or frame member 1. The to-and-fro displaceable movement of the carriage 7 has been indicated in FIG. 1 by the double-headed arrow identified by reference character C. At this carriage or carriage member 7 there engages one arm 10″ of an angle lever or lever member 10 which is pivotably mounted about the shaft or shaft member **10*a* in the frame or frame member 1. The other arm 10‴ of this angle lever 10 is operatively coupled with a piston-and-cylinder unit 11. By means of this piston-and-cylinder unit 11 the angle lever 10 is pivoted or rocked into the position indicated by reference character 10′, and thus, the carriage or carriage member 7 is displaced to the right of FIG. 1 in the direction of the arrow C. When the carriage or carriage member 7 is thus displaced in the direction of the arrow C the band or belt conveyor 3 is brought out of the operative position depicted in chain-dot lines in FIG. 1, in which this band or belt conveyor 3 is located at the wind-up location or position 5, into a retracted release position which has been shown in FIG. 1 with full lines and designated by reference character 3′**.

Furthermore, at the wind-up location or position 5 there is provided a hollow substantially cylindrical winding or wind-up core or mandrel 12 which possesses a throughpass channel **12*a* extending in the lengthwise direction of this winding core or mandrel 12. This winding core or mandrel 12 is freely rotatably mounted upon a pivotable or pivotal lever or lever member 13 which is pivotably seated upon a shaft or shaft member 14. This pivotable lever 13 together with the winding core or mandrel 12 can be pivoted or rocked in the direction of the double-headed arrow D (FIG. 1). Also in FIG. 1 there have been illustrated the pivotable lever 13 and the winding core or mandrel 12 with full lines in their lower pivoted position, whereas the upper pivoted position of the pivotable lever 13 and the hollow winding core or mandrel 12 has been shown in chain-dot lines and respectively designated by reference characters 13' and 12'. In its lower pivotable position the pivotable or pivotal lever 13 bears against a stop or impact member 15**.

Further belonging to the wind-up apparatus is an endless belt or belt member 16 or equivalent structure. This endless belt or belt member 16 is guided over a number of deflection rolls or rollers 17 to 22. As to these deflection rolls 17 to 22 the deflection rolls 17, 18, 19 and 20 are stationarily mounted in the frame or frame member 1, whereas the deflection rolls 20 and 22 are pivotably mounted. For this purpose the deflection roll 20 is mounted at one end of a lever or lever member 23 which is pivotably seated at its other or opposite end upon a shaft or shaft member 24. The lengthwise axis of this shaft or shaft member 24 substantially coincides with the axis of rotation of the deflection roll 21. The lever or lever member 23 and together therewith the deflection roll 20 can be pivoted to-and-fro in the direction of the double-headed arrow F. The one end or terminal position of the lever 23 and the deflection roll 20 has been depicted in chain-dot lines in 23' and 20', whereas the other end or terminal position has been shown with full or solid lines and indicated by reference characters 23 and 20, respectively. The deflection roll or roller 22 is mounted at one end of a double-arm lever or lever member 25 which is pivotably mounted in the direction of the double-headed arrow G (FIG. 1) about a shaft or shaft member 26 which is arranged in the frame or frame member 1 defining a housing. At the other lever arm there engages a piston-and-cylinder unit 27 which pivots or rocks the lever or lever member 25 together with the deflection roll 22 into the upper end or terminal position 25' and 22', respectively, depicted with full or solid lines. The lower end or terminal position of the lever or lever member 25 and the deflection roll 22 has been depicted with chain-dot lines. The deflection roll 17 is driven in clockwise direction by the drive unit or drive motor 6, so that the belt or belt member 16 is circulatingly or revolvingly driven in the direction of the arrow E (FIG. 1).

At the start of the wind-up operation the pivotal or pivotable lever 13 together with the winding core or mandrel 12 is located in the lower position depicted with full or solid lines, whereas the deflection roll 22 assumes the chain-dot illustrated end or terminal position and the deflection roll 20 assumes the end or terminal position depicted with full or solid lines. The belt or belt member 16 now travels from the deflection roll 17 over the deflection rolls 18 and 19 to the deflection roll 20, from the latter back over the deflection roll 19 to the deflection roll 21. From the location of this deflection roll 21 the belt or belt member 16 travels along the lower situated run of the band or belt conveyor 3, and thereafter upon the upperside or surface of the top or upper run to the winding core or mandrel 12. This winding core or mandrel 12 is wrapped along a portion of its circumference or outer surface by the belt or belt member 16 and then this belt or belt member 16 travels from the deflection roll 22 to the deflection roll 17. This belt or belt member 16 is partially illustrated in chain-dot lines. By means of the belt or belt member 16 the band or belt conveyor 3 is revolvingly or circulatingly driven in the direction of the arrow H (FIG. 1).

The imbricated formation S of printed products 4, delivered by the band or belt conveyor 2, arrives at the subsequent or second band or belt conveyor 3 and while reposing upon the belt or belt member 16 at the winding core or mandrel 12. This winding core or mandrel 12 is driven in counterclockwise direction by the belt or belt member 16. The infed imbricated formation S of printed products 4 is wound up upon the winding core or mandrel 12 between this winding core or mandrel 12 and while lying or reposing upon the belt or belt member 16. With increasing radius or size of the printed product roll or package roll which is being formed, and which bears upon the band or belt conveyor 3, the winding core or mandrel 12 is raised and upwardly pivoted or rocked in the direction of the arrow D about the pivot axis **13*a* (FIG. 2) defined by the shaft or shaft member 14. The deflection roll 22 is likewise upwardly pivoted or rocked in the direction of the arrow G by the increasing size or diameter printed product roll or package roll. To compensate the length of the endless belt or belt member 16 the arm or arm member 23 together with the deflection roll 20 pivots in counterclockwise direction from the position respectively depicted by reference characters 23 and 20, in the direction of the arrow F, towards the terminal or end position depicted by reference characters 23' and 20', respectively. Regarding the formation of the printed product roll or package roll such will be considered more fully hereinafter in conjunction with FIGS. 3 to 8**.

Furthermore, at the wind-up location or position 5 there is situated a substantially plate-shaped ejector or ejection mechanism 28 secured at one of a rod or rod member 29. This rod or rod member 29 is displaceably guided in a suitable bearing or mounting structure 30 in the direction of the arrow L (FIG. 2). In order to displace the ejector or ejection mechanism 28 there is operatively connected therewith a piston-and-cylinder unit 31, as best seen by referring to FIG. 2.

Arranged substantially axially parallel to the hollow winding core or mandrel 12 and in neighboring relationship thereto is a package receiving or take-up core or mandrel 32 carrying a stop or impact member 33. This receiving or take-up core or mandrel 32 is secured at a holder or support means generally designated by reference character 34. This holder or support means 34 can be moved up and down or elevationally displaced in the direction of the double-headed arrow J. The upper end or terminal position of the receiving or take-up core or mandrel 32 is limited by a stop or impact member 35. In this upper end or terminal position the lengthwise axis of the receiving or take-up core 32 is in general alignment with the lengthwise axis of the wind-up core or mandrel 12 located in its lower end or terminal position. A suitable and conventional drive or drive means for raising and lowering the holder or support means 34 in the direction of the double-headed arrow J has only been schematically illustrated and generally designated by reference character 36. By means of this drive 36 it is possible to rotate the holder or support means 34 and thus also the receiving or take-up core 32 about the lengthwise axis **34*a* of the holder or support means 34**.

Arranged beneath the receiving or take-up core or mandrel 32 is a package support table 37 or equivalent structure and a knotting unit or mechanism 38. This knotting unit or mechanism 38 typically is of conventional construction and possesses a knotting location or position generally indicated by reference character 39. The knotting unit or mechanism 38 may correspond in its construction and mode of operation to knotting units or mechanisms as such are conventionally employed in standard package wrapping machines. At the knotting location or position 39 there is fixedly retained or held one end 40*a* of a suitable filamentary or tying material, typically a cord, rope or string 40 or the like—herein generally simply usually referred to as a cord or string—. This cord or string 40 extends from the knotting location or position 39 to the hollow winding core or mandrel 12, then passes or extends through the throughpass or open-ended channel or passageway 12*a* thereof and to a cord or string supply roll or supply means 41, as best seen by referring to FIGS. 3 to 8. At its end confronting the cord or string supply roll or supply means 41 the throughpass channel or passageway 12*a* is provided with a cord or string brake unit 42.

Between the winding core or mandrel 12 and the receiving or take-up cord 32 there is arranged an entrainment means or entrainment member 43 which can be moved up and down or elevationally displaced in the direction of the double-headed arrow K. In FIG. 2 there has been illustrated the guide or guide means 44 for this entrainment means or entrainment member 43.

In the description to follow there will be explained in greater detail the mode of operation of the described apparatus based, in particular, upon the illustrations of FIGS. 3 to 8.

The imbricated formation S of printed products 4, infed or delivered by the band or belt conveyor 2, is delivered to the winding core or mandrel 12 (FIG. 3) located in the starting position. In this starting position the cord or string 40 extends from the cord or string supply roll or supply means 41 through the winding core throughpass channel 12*a* to the knotting location or position 39. The infed imbricated formation S of printed products 4 has already, as previously explained, been wound-up between the winding core or mandrel 12 and the belt or belt member 16 upon such winding core or mandrel 12. Hence, as also previously discussed with increasing diameter or size of the wound-up printed product roll or package roll the winding core or mandrel 12 and the deflection roll 22 are raised.

Towards the end of the wind-up operation there is placed a suitable wrapping element or envelope 46 or equivalent structure beneath the trailing end or terminal portion of the imbricated formation S which is to be still wound-up. This wrapping element or envelope 46 can be constituted, for instance, by a transparent plastic foil possessing self-adhesion properties, as the same has been disclosed in the previously mentioned German Published Patent Application No. 3,330,485 and the corresponding British Published Patent Application No. 2,126,188 and the aforementioned copending, cognate U.S. application Ser. No. 06/818,356, now U.S. Pat. No. 4,688,368, granted Aug. 25, 1987. This wrapping element or envelope 46 is wound up together with the imbricated formation S of printed products 4 and, as shown for instance in FIGS. 4 and 5, surrounds or encircles the finished or completed package roll at its outer side or surface and retains such together, as the same has been fully disclosed in the aforementioned German and British patent documentation and copending United States application.

Figure 4:
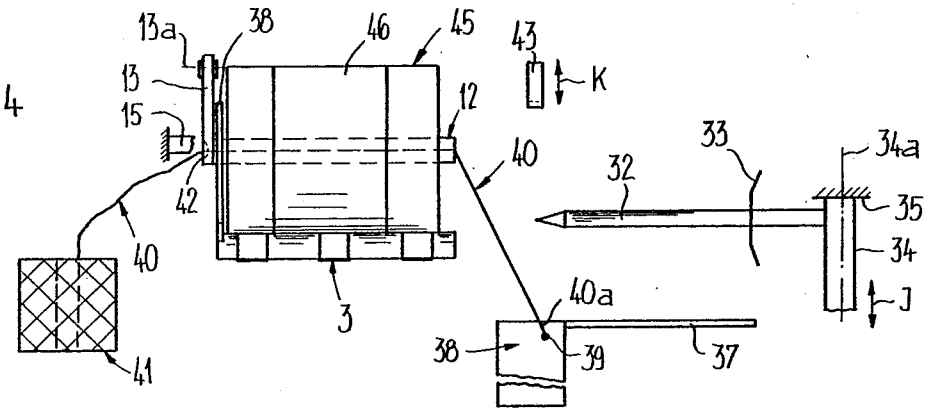

In FIGS. 1 and 4 there has been illustrated a finished wound printed product roll or package roll 45 with the wrapping element or envelope 46 wrapped thereabout and for instance inwardly spaced from opposite ends of the package roll 45 and retaining together such finished wound or formed printed product roll or package roll 45. This printed product or package roll 45, which has been illustrated in chain-dot lines in FIG. 1, still lies or reposes upon the band or belt conveyor 3.

Now the band or belt conveyor 3 is retracted towards the right of FIG. 1 by means of the piston-and-cylinder unit 11 in the corresponding direction of the arrow C into the release position designated in FIG. 1 with full or solid lines and by reference character 3'. As as result, the finished wound product or package roll 45 is lowered to such an extent until the pivotal or pivotable arm 13 impacts against the stop or impact member 15. The lower end or terminal position of the finished wound package roll 45 has been designated by reference character 45' and illustrated in FIGS. 1, 2 and 5. In this lower end or terminal position the lengthwise axis of the winding core 12 is essentially in alignment with the lengthwise axis of the package receiving or take-up core or mandrel. 32, which, as illustrated in FIGS. 2 and 5, assumes its upper end or terminal position in which the holder or support means 34 bears against the stop or impact member 35.

At this point by means of the piston-and-cylinder unit 27 the lever or lever member 25 together with the deflection roll 22 is pivoted into the upper end or terminal position 25' and 22', respectively, depicted in FIG. 1 with full or solid lines. Additionally, the lever or lever member 23 together with the deflection roll 20 is pivoted into the end or terminal position depicted by reference characters 23 and 20, respectively, and likewise shown in FIG. 1 with full or solid lines. In such end or terminal positions of the deflection rolls 22' and 20 and with the band or belt conveyor 3 in its release position, the belt or belt member, designated by reference character 16' and shown with full or solid line, extends from the deflection roll 19 to the band 1 or belt conveyor 3', along the underside of this band or belt conveyor 3' and then along a portion of the circumference of the lowered product or package roll or roll member 45' to the deflection roll 22', as such has been depicted in FIG. 1.

Figures 5, 6:
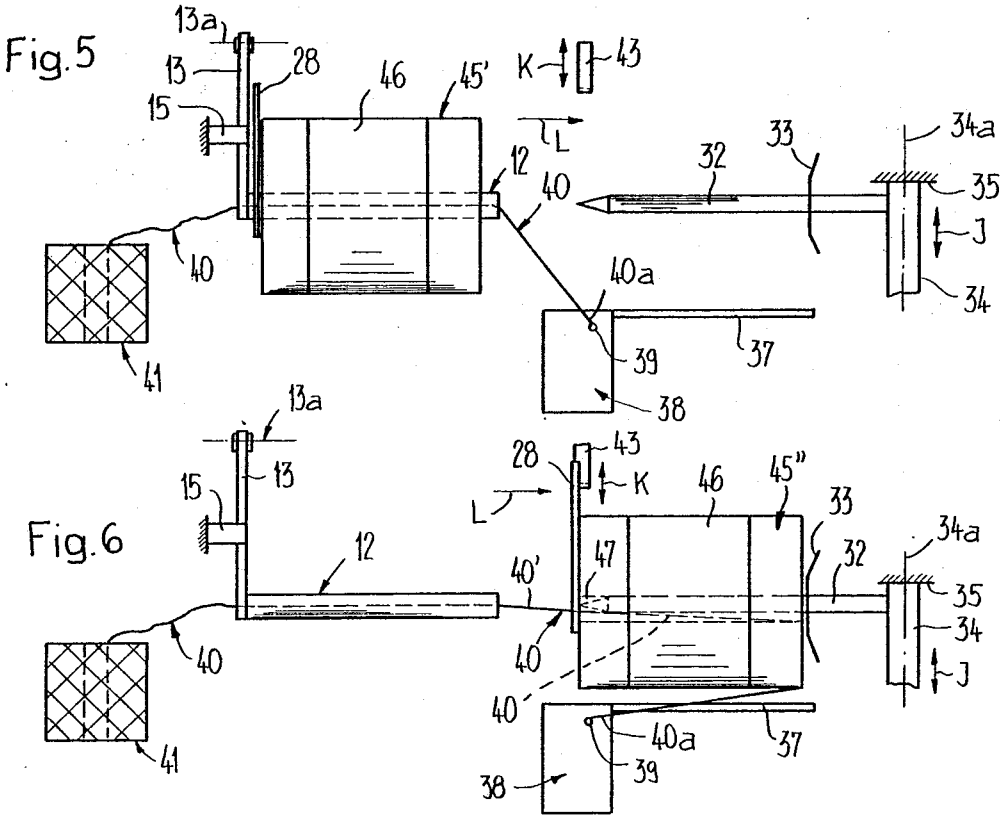
Figure 7:
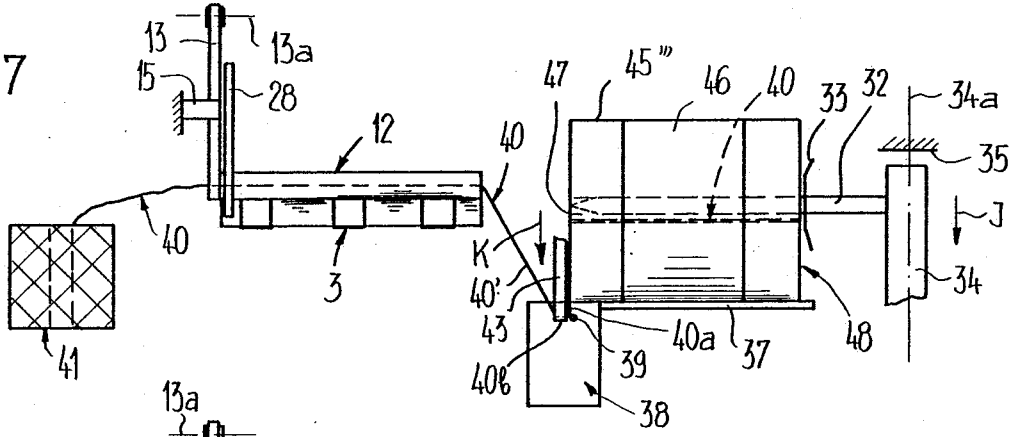

With this course of travel of the belt or belt member 16' it is now possible, during a next following operational step, to displace the lowered package roll 45' by means of the ejector or ejection mechanism 28 which has been advanced in the direction of the arrow L, onto the receiving or take-up core or mandrel 32, as the same has been depicted in FIGS. 2 and 6. The ejector or ejection mechanism 28 displaces the package roll 45' to such an extent onto the receiving or take-up core 32 until this package roll 45' bears against the stop or impact member 33 (position 45 ", as shown in FIGS. 2 and 6). During this displacement movement of the package roll 45' from the winding core or mandrel 12 onto the receiving or take-up core or mandrel 32 the package roll 45' entrains by means of its leading end side or face the cord or string 40 or the like and drags or pulls such from the cord or string supply roll 41 or equivalent structure, as the same is readily apparent from the illustration of FIG. 6. The cord or string 40 now travels from the knotting location or position 39, in which there is fixedly retained the cord or string end 40*a*, through the internal or inner opening or hollow interior 47 of the package roll 45'' and through the throughpass channel or passageway 12a in the hollow winding core or mandrel 12.

By means of the drive or drive means 36 the holder or support means 34 and together therewith the receiving or take-up core 32 is lowered in the corresponding direction of the double-headed arrow J to such an extent until the package roll 45'' bears upon the support table 37 or equivalent structure. The package roll located in this position has been designated in FIGS. 2 and 7 by reference character 45'''. In the meantime the band or belt conveyor 3 has again been moved back into its operative position and the ejector or ejection mechanism 28 has been retracted, as such has been illustrated in FIG. 7. Additionally, the deflection rolls 20 and 22 are again located in their starting position depicted in FIG. 1 respectively by full lines and chain-dot lines. Consequently, it is now possible to begin with the formation of a new package roll or wound product package.

The entrainment means or member 43 is now lowered in the corresponding direction of the double-headed arrow K and in so doing engages the portion or section 40' of the cord or string 40 which extends between the winding core or mandrel 12 and the package roll 45''' which is located upon the receiving or take-up core 32 and leads such cord or string portion 40' to the knotting location or position 39. At this knotting location or position 39 the end 40b of the cord or string portion or section 40' is knotted or tied with the other cord or string end 40a in conventional fashion. Behind the formed knot the cord or string 40 is cut and the now free end of the cord section or portion 40' is again fixedly retained at the knotting location 39. There has been now formed about the package roll 45''' a carrying or carrier loop or handle 48 or equivalent package handling or carrying facility, which consists of a piece of cord or string which, on the one hand, extends through the inner opening or hollow interior 47 of the package roll 45''' and, on the other hand, extends about the package roll 45''' at its outer surface or side.

The package roll 45''' which is provided with a carrying loop 48 or equivalent structure is now raised off of the support table 37 by raising the holder or support means 34 and the receiving or take-up core or mandrel 32. Thereafter the holder or support means 34 is rotated through an angle of approximately 90° about its lengthwise axis 34a, as the same has been depicted in FIG. 8. The package roll 45, designated in FIG. 8 by reference character 45'''', can now be ejected or pushed off of the package receiving or take-up core or mandrel 32.

Figure 8:
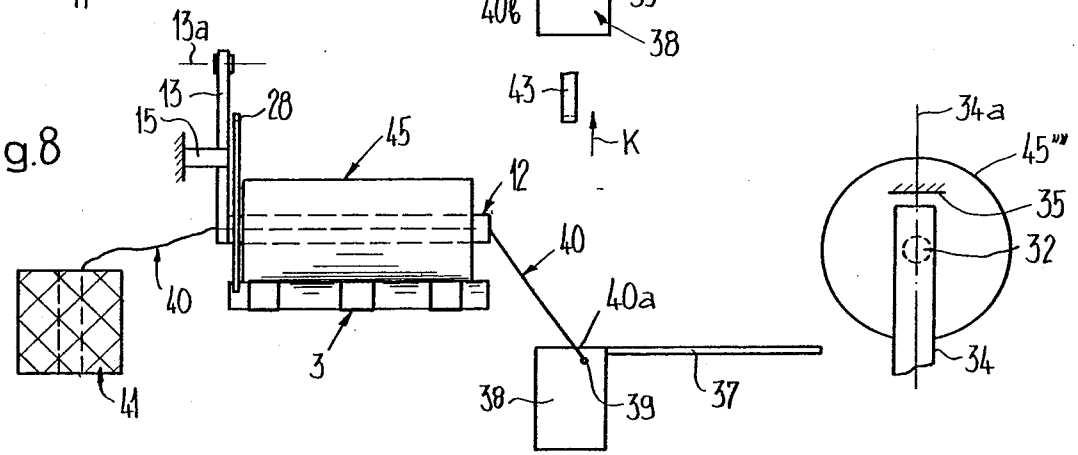

As further apparent by referring to FIG. 8, the entrainment means or member 43 is upwardly retracted in the corresponding direction of the double-headed arrow K. A new package roll 45 is now formed upon the winding core or mandrel 12 in the aforedescribed manner. Just as was the case for the illustration of FIG. 3, the free end 40a of the cord or string 40 is fixedly retained at the knotting location or position 39, from which location the cord or string 40 or the like passes through the throughpass channel or passageway 12a in the hollow winding core or mandrel 12 to the cord or string supply roll 41. This new package roll 45, after it has been finished formed or wound, is likewise provided in the aforedescribed manner with a carrying or carrier loop 48 or the like.

Figure 9:
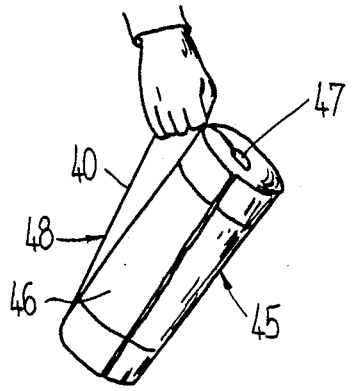
FIG. 9 illustrates one form of printed product roll or package roll provided with a carrying or carrier loop.
Figure 10:
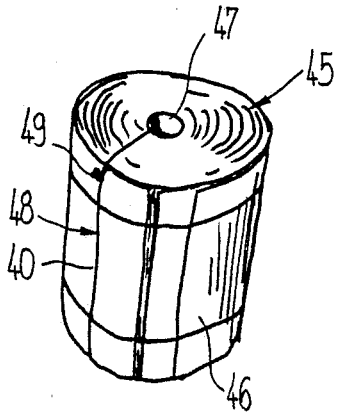
FIG. 10 illustrates in perspective view a further embodiment of printed product roll or package roll equipped with a carrying or carrier loop.

In FIGS. 9 and 10 there have been shown in perspective illustration printed product rolls or package rolls 45 provided with a carrying or carrier loop 48 or similar handle or facility for portable transport of such package rolls. These carrying or carrier loops 48 for the printed product rolls or package rolls 45 are formed by a piece of knotted cord or string 40. In FIG. 10 the knot has been depicted by reference character 49. This carrying or carrier loop 45 renders it possible to handle the printed product roll or package roll 45 in a simple fashion, and in particular, to manually carry the same, i.e. renders it readily portable. This carrying or carrier loop 48 can be applied in the previously described manner in a fully automated fashion and without any considerable increased expenditure in time. Since the formation of the carrying or carrier loop 48 or the like is accomplished adjacent the actual wind-up location or position 5, it is possible to form a new package roll during the time that a previously formed package roll has applied thereto the carrying or carrier loop 48 or the like.

Instead of using a cord or string 40 there can also be employed as the carrying element or handle, for instance a plastic band, the ends of which can be interconnected by heat sealing or welding. Instead of using a knotting unit or apparatus there would then be employed a heat sealing unit or welding unit, as the case may be. Moreover, the application of the carrying or carrier loop formed of such plastic band or strap is accomplished approximately in the same manner as during the application of a cord or string.

It also would be conceivable to extract the finished wound package roll 45' from the receiving or take-up core or mandrel 12 in that there is not ejected the wound package roll 45', rather the winding core or mandrel 12 is retracted out of the finished wound package roll 45'. In this connection the formation of the carrying or carrier loop 48 would be accomplished in a manner similar to that previously described.

While there are shown and described present preferred embodiments of the invention, it is to be distinctly understood that the invention is not limited thereto, but may be otherwise variously embodied and practiced within the scope of the following claims. ACCORDINGLY,

What I claim is:

1. A method for fabricating portable, substantially tubular-shaped packages from printed products, such as newspapers, periodicals and the like, comprising the steps of:

winding up into a package roll printed products infed in an imbricated formation, with the thus formed package roll having a hollow interior and an outer surface;

placing a holding element around the package roll in order to retain together said package roll;

guiding an elongate carrying element through the hollow interior of the package roll and along the outer surface of the package roll;

forming from such elongate carrying element an endless carrying loop which extends around the package roll;

interconnecting the ends of the elongate carrying element guided through the hollow interior of the package roll;

guiding the elongate carrying element through a hollow winding core upon which there are wound up the printed products;

withdrawing the formed package roll from the hollow winding core; and then forming from the carrying element extending through the hollow interior of the package roll the endless carrying loop.

2. The method as defined in claim 1, further including the steps of:

fixedly retaining the elongate carrying element at one end externally of the hollow winding core; and during withdrawal of the package roll from the hollow winding core removing from a storage a further supply of the elongate carrying element.

3. The method as defined in claim 4, further including the step of:

using as the storage a supply roll for the elongate carrying element.

4. A method for fabricating portable, substantially tubular-shaped packages from printed products, such as newspapers, periodicals and the like, comprising the steps of:

winding up into a package roll printed products infed in an imbricated formation, with the thus formed package roll having a hollow interior and an outer surface;

placing a holding element around the package roll in order to retain together said package roll;

guiding an elongate carrying element through the hollow interior of the package roll and along the outer surface of the package roll;

forming from such elongate carrying element an endless carrying loop which extends around the package roll;

guiding the elongate carrying element through a winding core upon which there are wound up the printed products;

withdrawing the formed package roll from the winding core; and then forming from the carrying element extending through the hollow interior of the package roll the endless carrying loop.

5. An apparatus for the fabrication of portable, substantially tubular-shaped packages of printed products, such as newspapers, periodicals and the like, comprising:

means for winding up printed products infed in an imbricated formation so as to form a package roll;

means for applying a holder element for retaining together the package roll about such package roll;

means for forming an endless carrying loop surrounding the formed package roll;

said means for forming said endless carrying loop forming said carrying loop from an elongate carrying element extending through an interior region of the package roll and along an outer surface of the package roll;

said means for winding up the printed products infed in imbricated formation comprising a winding core for winding up the printed products thereupon;

said winding core possessing a lengthwise axis;

said winding core containing a throughpass channel extending in the direction of its lengthwise axis;

said elongate carrying element being guided through said throughpass channel;

means for withdrawing the formed package roll from the winding core; and said means for forming the endless carrying loop being associated with said formed package roll withdrawn from said winding core by means of said package roll withdrawal means and containing said elongate carrying element which extends through the interior region of the package roll.

6. The apparatus as defined in claim 5, further including:

storage means for the elongate carrying element for paying off a supply of the elongate carrying element which passes through the throughpass channel of the winding core;

retention means for retaining one end of the elongate carrying element which has passed through the winding core.

7. The apparatus as defined in claim 6, wherein:

said storage means comprises a supply roll for the elongate carrying element.

8. The apparatus as defined in claim 5, wherein:

said elongate carrying element defining two ends; and said means for forming said endless carrying loop containing connection means for interconnecting said two ends of the elongate carrying element.

9. The apparatus as defined in claim 6, further including:

connection means for interconnecting two ends of the carrying element; and said retention means being formed by said connection means.

10. The apparatus as defined in claim 6, further including:

a receiving core for the reception of the package roll withdrawn from the winding core;

an entrainment member for infeed of a portion of the elongate carrying element to the retention means; and said entrainment member acting upon a portion of the elongate carrying element which extends between the winding core and the receiving core.

11. The apparatus as defined in claim 8, wherein:

said elongate carrying element comprises a cord;

said connection means comprises a knotter unit.

12. The apparatus as defined in claim 8, wherein:

said elongate carrying element comprises a plastic band; and said connection means comprises a connection device.

13. The apparatus as defined in claim 12, wherein: said connection device comprises a heat sealing device.

14. The apparatus as defined in claim 12, wherein:

said connection a device comprises welding device.

15. The apparatus as defined in claim 5, wherein:

said means for winding up further comprises an endless driven belt guided about said winding core; and said endless driven belt being intended to bear upon the outer surface of the package roll forming upon the winding core.

16. The apparatus as defined in claim 15, further including:

a band conveyor serving as support means for the package roll; and said endless driven belt being guided over said band conveyor.

17. The apparatus as defined in claim 16, wherein:

said band conveyor being revolvingly driven by said endless driven belt.

18. The apparatus as defined in claim 16, further including:

means for enabling adjustment of the spatial position of the winding core in relation to the band conveyor.

19. The apparatus as defined in claim 18, further including:

means for displacing the band conveyor out of an operative position supporting the package roll into a release position in which said band conveyor can be brought out of supporting engagement with the package roll.

20. The apparatus as defined in claim 15, further including:

a band conveyor serving as support means for the package roll; and means for enabling altering of the spatial position of the winding core in relation to the band conveyor.

21. The apparatus as defined in claim 20, further including:

means for displacing the band conveyor out of an operative position supporting the package roll into a release position in which it can be brought out of supporting engagement with the package roll.

22. A method for fabricating portable, substantially tubular-shaped packages from printed products, such as newspapers, periodicals and the like, comprising the steps of:

winding up upon a winding core containing an elongate carrying element extending therethrough, an infed imbricated product formation into a package roll having a hollow interior and an outer surface;

placing a holding element around the package roll in order to retain together said package roll;

separating by displacing relative to each other said winding core and said package roll and thereby guiding said elongate carrying element through the hollow interior and along the outer surface of said package roll; and forming from such elongate carrying element an endless carrying loop which extends around the package roll.

23. An apparatus for the fabrication of portable, substantially tubular-shaped packages of printed products, such as newspapers, periodicals and the like, comprising;

means for winding up printed products infed in an imbricated formation so as to form a package roll upon a winding core containing an elongate carrying element extending through said winding core;

means for applying a holder element about the formed package roll for retaining together the package roll;

means for separating the formed package roll and the winding core by relative displacement with respect to each other;

said separated formed package roll defining an interior region and an outer surface and said elongate carrying element extending through said interior region and along said outer surface of said separated formed package roll;

means for forming an endless carrying loop surrounding the separated formed package roll; and said means for forming said endless carrying loop, forming said endless carrying loop from said elongate carrying element extending through said interior region and along said outer surface of said separated formed package roll.

* * * * *